US007260340B2

(12) United States Patent
Ullrich et al.

(10) Patent No.: US 7,260,340 B2
(45) Date of Patent: Aug. 21, 2007

(54) SYSTEM AND METHOD FOR TRANSFER OF AN ELECTRICAL VOLTAGE TO/FROM A ROTATING ROLLER

(75) Inventors: Michael Ullrich, Poing (DE); Stefan Brecht, München (DE); Friedrich Meschenmoser, Grasbrunn (DE)

(73) Assignee: Oce Printing Systems GmbH, Poing (DE)

( * ) Notice: Subject to any disclaimer, the term of this patent is extended or adjusted under 35 U.S.C. 154(b) by 127 days.

(21) Appl. No.: 10/928,590

(22) Filed: Aug. 27, 2004

(65) Prior Publication Data

US 2006/0045556 A1 Mar. 2, 2006

(51) Int. Cl.
*G03G 15/00* (2006.01)

(52) U.S. Cl. ..... 399/90; 399/88; 399/89; 399/121

(58) Field of Classification Search ..... 399/88, 399/89, 90, 121
See application file for complete search history.

(56) References Cited

U.S. PATENT DOCUMENTS 3,477,369 A * 11/1969 Adamson et al. ..... 101/153
4,412,457 A * 11/1983 Colvin et al. ..... 74/7 A
4,539,908 A * 9/1985 Spengler ..... 399/239
5,729,788 A * 3/1998 Hirohashi et al. ..... 399/66
6,064,841 A * 5/2000 Matsuzaki et al. ..... 399/90
6,382,837 B1 * 5/2002 Olbrich et al. ..... 384/278
2002/0001481 A1 * 1/2002 Kiuchi ..... 399/122
2002/0176720 A1 * 11/2002 Lee et al. ..... 399/88
2003/0021611 A1 * 1/2003 Anthony et al. ..... 399/67
2004/0005165 A1 * 1/2004 Yoon et al. ..... 399/88
2004/0091293 A1 5/2004 Frodl et al.

FOREIGN PATENT DOCUMENTS

WO WO 02/077719 A1 10/2002

* cited by examiner

*Primary Examiner*—David M. Gray
*Assistant Examiner*—Ryan D. Walsh
(74) *Attorney, Agent, or Firm*—Schiff Hardin LLP

(57) ABSTRACT

In order to be able to supply a rotating transfer roller in a transfer printing station of an electrophotographic printing device with a high voltage, a system and method is proposed that comprises a voltage transfer device with an elastically borne brush, a compensation device with a bushing standing under spring force, and a monitoring device with a Hall switch. For voltage transfer, the brush is pressed onto the voltage connection location of the transfer roller. For compensation of the axial play of the transfer roller, the bushing is pressed onto the bearing of the transfer roller. For monitoring as to whether a transfer roller is connected with the device, the Hall switch is used which checks whether the bushing has been moved or not.

15 Claims, 5 Drawing Sheets

SYSTEM AND METHOD FOR TRANSFER OF AN ELECTRICAL VOLTAGE TO/FROM A ROTATING ROLLER

BACKGROUND

As an example for the transfer of an electrical voltage onto a rotating roller, a transfer roller in a transfer printing station of an electrophotographic printing or copying device can be referred to. For this, WO 02/077719 can be referenced. A high voltage must be transferred onto the transfer roller in order to enable the transfer printing of toner images from an intermediate carrier (for example a photoconductor drum) onto a recording medium (for example paper). For details of the transfer printing, WO 02/077719 (which is incorporated into the disclosure) is referenced.

A device with which an electrical voltage is transferred from a voltage source onto a rotating roller (for example a transfer roller) should be able to accomplish additional tasks in addition to the voltage transfer. In addition to the voltage transfer and necessary insulation, the device should be able to compensate the axial play of the roller bearing. In addition to this, the roller should be able to be exchanged easily and safely and it should be possible to determine whether the roller is connected with the device or not. The device should furthermore be realized as an integrated unit.

SUMMARY

It is an object to specify a device that is realized as an integrated unit that can transfer a high electrical voltage and can compensate the axial play of the roller after connection with the rotating roller.

To transfer an electrical voltage to and from a rotating roller where one side of the roller is connected with a bearing, a voltage transfer device on one side elastically attaches to a voltage connection of the roller when the voltage transfer device is connected with the roller. On the other side, the voltage transfer device is connected with an external cable. A compensation device compensates axial play of the roller after connection with the roller transfer device.

DESCRIPTION OF THE PREFERRED EMBODIMENTS

Figure 1:
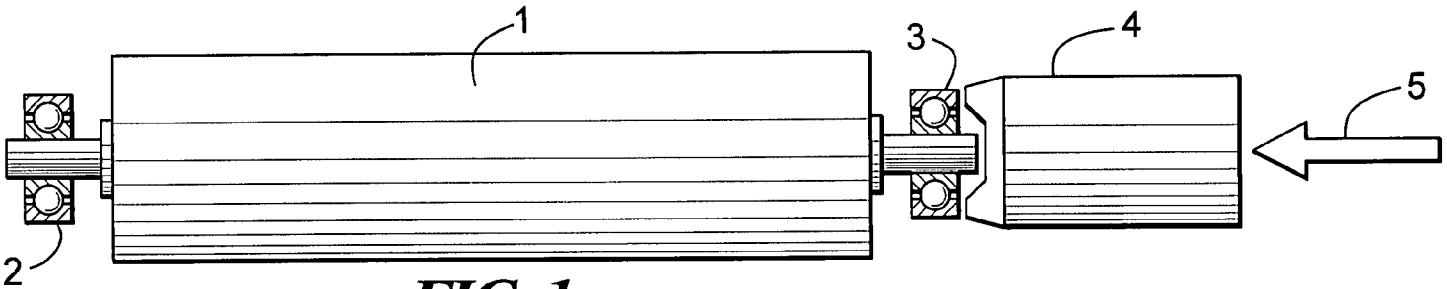
FIG. 1 is a principle representation that schematically shows the transfer of the voltage onto the roller.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A voltage transfer device is provided that on one side is elastically attached to the voltage connection after connection of the device with the roller, and which on the other side is connected with an external cable. Furthermore, a compensation device is provided that is designed such that it can compensate the axial play of the roller after connection with the device.

Furthermore, a monitoring device can be provided that establishes whether a roller is connected with the device or not.

The voltage transfer device can advantageously comprise

- an electrically-conductive brush, axially moveable in a fixed guide element, whose one side is aligned towards the roller,
- a sealing cap closing the guide element, to which sealing cap the external cable is connected and from which an internal cable goes to the brush,
- a brush spring that exerts an elastic effect on the brush, arranged between the brush and the sealing cap.

The guide element can be held in a brush mounting that is fixed in a forward tube.

For connection of the device with the roller, a forward flange that can be connected with a bearing acceptance of the roller can be arranged on the front side of the device.

The compensation device may comprise

- a rear tube in which a rear flange is inserted into the backside of the device,
- a bolt mounting that can be axially moved on the rear tube,
- a compression or pressure spring that exerts an elastic force on the bolt mounting, arranged on the rear tube between bolt mounting and rear flange,
- bolts that are mounted in the bolt mounting and that are in effective connection with a bushing that is axially movably positioned in the forward flange and on which the compression spring exerts an elastic force via the bolt mounting and the bolts. The bolts can additionally still be guided into the brush mounting.

In order to prevent the bushing from slipping out of the device, this can be provided with a web to which the bolts are attached on the one side and that is formed on the other side such that the bushing hits the forward flange before it can leave the device.

The rear tube can be closed with a cable threading through which the external cable is guided to the sealing cap.

The monitoring device can appropriately be a Hall switch whose magnet is arranged on the bolt mounting and whose sensor is attached to the forward tube.

For insulation of the voltage transfer, the guide element and the brush mounting can be comprised of an insulating material, for example a plastic.

The device can in particular be used for voltage feeding of a transfer roller in the transfer printing station of an electrophotographic printing or copying device. A high voltage must be supplied to this, whereby the transfer roller must be easily exchangeable. With the compensation device, the axial play of the transfer roller can be compensated such that the device securely attaches to the transfer roller; with the monitoring device, it can be established whether a transfer roller is used in the transfer printing station or not.

The device can be used not only in order to feed a voltage to a roller; it can just as well be used in order to discharge or conduct a voltage from a roller.

According to FIG. 1, an electrical voltage should be applied to a rotating roller 1, for example a transfer roller in the transfer printing station of an electrophotographic printing device according to WO 02/077719 A1. The roller is supported by bearings 2, 3. Device 4 should now be coupled to the roller 1 and in fact to the bearing 3 in order to supply the roller 1 with voltage 5. The rotation of the roller 1 may not thereby be impaired. This means that the device 4 should be connected with roller 1 such that the roller 1 can further rotate unhindered, but in spite of this the voltage 5 is safely transferred to the roller 1.

Furthermore, the device 4 should be designed such that an axial play of the roller 1 can have no influence on the voltage transfer after the connection of the device 4 with the roller 1. According to FIG. 2, the device is therefore realized such that the device 4 elastically abuts on the bearing of the roller 1 via a compression spring 6. In this manner, the device 4 can compensate the axial play of the roller 1.

Finally, it can be established with the device 4 whether a roller 1 is connected with the device 4 or not. The device 4 according to FIG. 3 correspondingly comprises a switch 7 that is, for example, opened when a roller 1 is coupled to the device 4.

Figure 2:
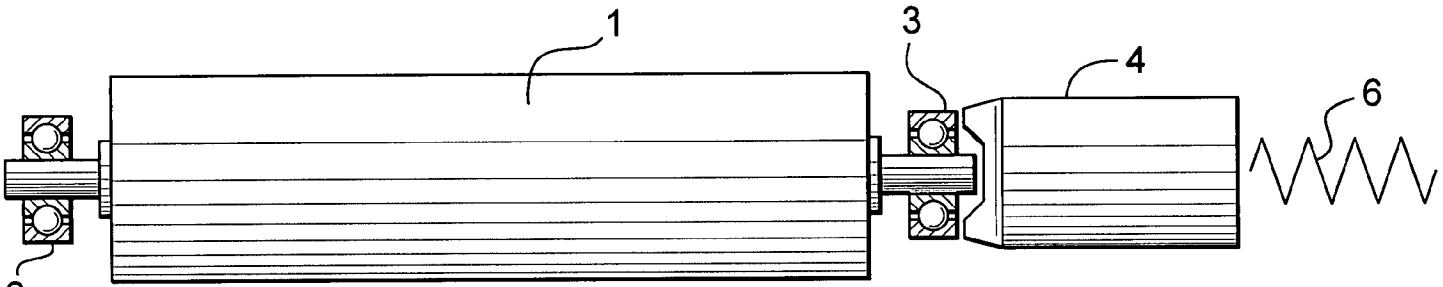
FIG. 2 is a principle representation that schematically shows the axial play compensation of the bearing of the roller.
Figure 3:
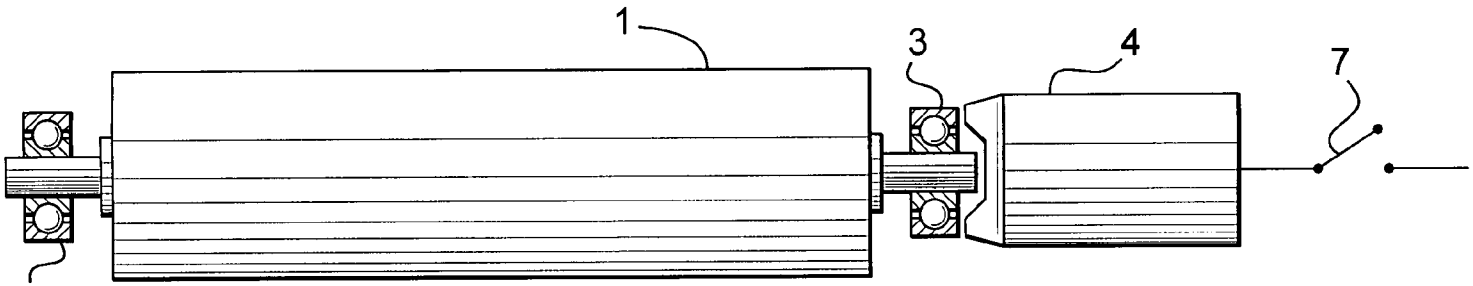
FIG. 3 is a principle representation that schematically shows the monitoring function with which it is established whether a roller is coupled or not.
Figure 4:
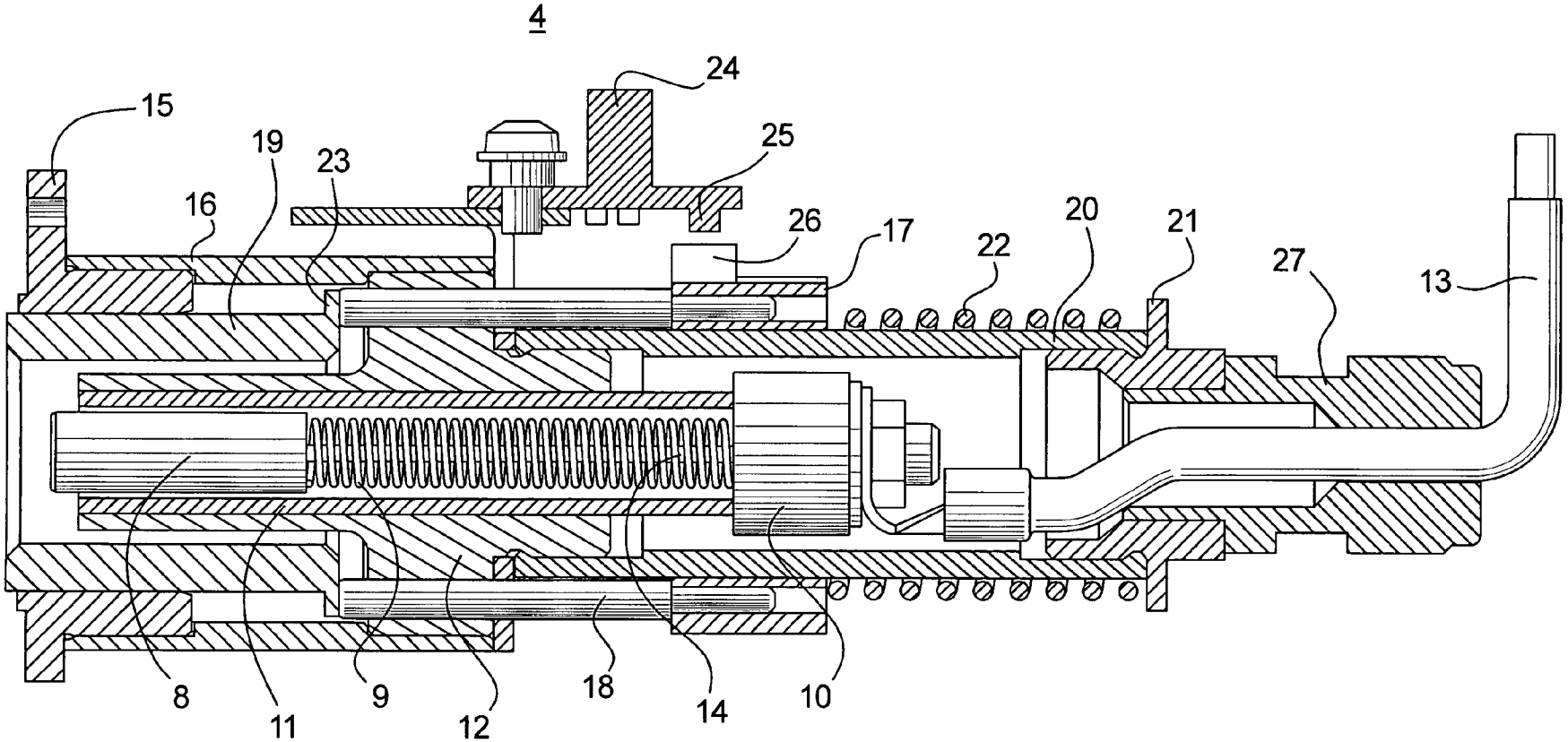
FIG. 4 is a section through the device.

FIG. 4 now shows a realization of the device 4 with which the objects according to FIG. 1 through 3 are achieved. This comprises a voltage transfer device, a connection device, an axial play compensation device and a monitoring device.

The voltage transfer device comprises an electrically-conductive brush 8, a brush spring 9, a sealing cap 10, a guide element 11, and a brush mounting 12.

The brush 8 is positioned in the guide element 11 such that it can axially move. It stands under the elastic force of the brush spring 9 that is arranged between brush 8 and the sealing cap 10. An external cable 13 is screwed onto the sealing cap 10; an internal, flexible cable 14 within the brush spring travels from the sealing cap 10 to the brush 8. The guide element 11 is finally held in the brush mounting 12. The brush 8 thus stands under elastic tension in the direction towards the open side of the device 4 (front side of the device 4 to which the roller 1 is coupled) via the brush spring 9.

The connection device comprises a forward flange 15 that is mounted in a forward tube 16. The forward flange 15 can be connected with a bearing acceptance 32 (FIG. 5) for the roller 1, for example it can be screwed to it.

The compensation device comprises a bolt mounting 17 in which the bolts are mounted, a bushing 10 that is positioned such that it can move in the forward flange 15 and to which the bolts 18 attach, a rear tube 20 to which the bolt mounting 17 is borne such that it can move, a rear flange 21 mounted in the rear tube 20, and a directed compression spring 22 (corresponding to the spring 6 in FIG. 2) arranged on the rear tube 20 between the rear flange 21 and the bolt mounting 17.

Via the bolt mounting 17 and the bolts 18, the compression spring 22 exerts a spring force on the bushing 19 in the direction towards the front side of the device 4. The bushing 19 comprises on the rear end a web 23 that prevents the bushing 19 from being able to slide out of the device 4, since the web 23 first impinges on the forward flange 15. Additionally, the bolts 18 can attach to the web 23.

The monitoring device (corresponding to switch 7 in FIG. 3) comprises a sensor mounting 24 with, for example, a Hall sensor 25, and a magnet 26.

The sensor mounting 24 is attached to the forward tube 16 such that the Hall sensor is stationary. The magnet 26 is attached opposite this on the bolt mounting 17 that is axially movable. When the roller 1 is connected with the forward flange 15, the bearing 29 (FIG. 5) shifts the bushing 19 into the device 4, counter to the elastic force of the compression spring 22; the magnet 26 is thereby shifted to the right with the bolt mounting 17; and this shift is measured by the Hall sensor 25.

A cable connection 27 that guides the external cable 13 into the device 4 is screwed into the rear end of the device 4 on the rear flange 21.

Figure 5:
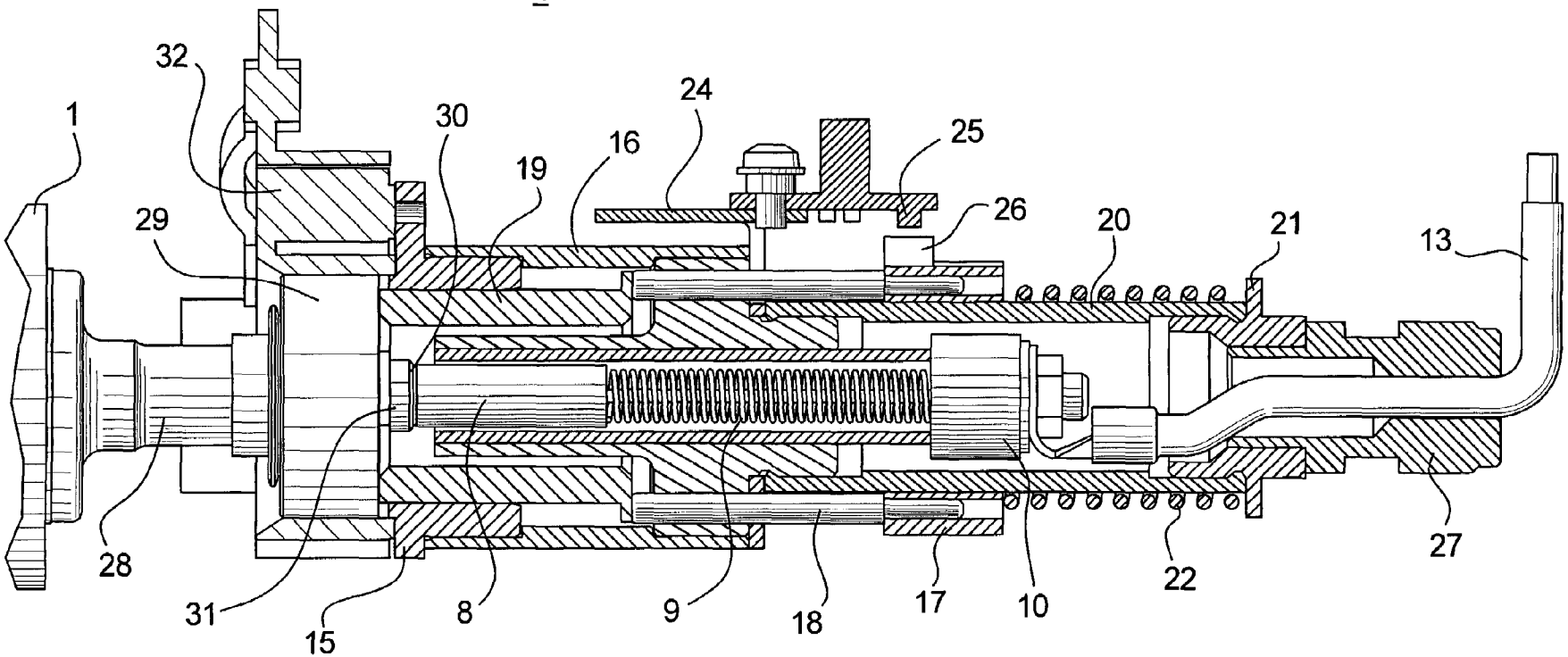
FIG. 5 is a section through the device given a coupled roller.

FIG. 5 shows the device 4 after its connection with the roller 1. The roller 1 ends with the flange 28 in a bearing 29 that is arranged in a bearing acceptance 32. When the device 4 with the forward flange 15 is screwed together with the bearing acceptance 32, the bushing 19 elastically connects to the bearing 29 of the roller 1 and the brush 8 elastically attaches to the connection point 30 of the roller 1 (contact location between brush 8 and roller axis 31). The electrical voltage is transferred to the roller 1 with the aid of the brush 8. Upon sealing, the elastically borne brush 8 thereby automatically readjusts itself. The electrical insulation of the components participating in the voltage transfer is achieved in that the brush mounting 14 is produced, for example, from fabric-base laminate, the guide element 11 is produced, for example, from plastic, and the cable 14 is insulated and is secured by means of a threaded cable connection 27.

The compensation of the axial play of the roller 1 is achieved via the compression spring 22 that exerts a spring force on the bushing 19 via the bolt mounting 17 and the bolts 18 and presses the bushing 19 onto the bearing 29. The bushing 19 is thereby undetachably borne in the forward tube 16 and the forward flange 15.

When the roller 1 is connected with the device 4, the bolt mounting 12 shifts with the magnet 26 and switches the Hall sensor 25. It is thereby monitored as to whether a roller 1 is coupled or not.

A voltage of up to 5000 V with a current of up to 200 μA can be transferred with the device 1. The roller rotation frequency can be up to 15 revolutions per second; the axial initial load can be 10 to 14 N.

It is easily visible from FIG. 4 and FIG. 5 how the compression spring 22 acts on the bushing 19 via the bolt mounting 17 and the bolts 18. The bolts 18 are thereby additionally guided into the brush mounting 12 that, for its part, is fastened in the forward and rear tube 16, 20. Furthermore, the forward flange 15 is fastened in the forward tube 16. The brush mounting 12 holds the guide element 11 that is firmly arranged with it. The fixed connections of the individual components with one another can be achieved via gluing. In contrast to this, moving components are the brush 8 with brush spring 9, the bolt mounting 17, the bolts 18 and the bushing 19.

Figure 6:
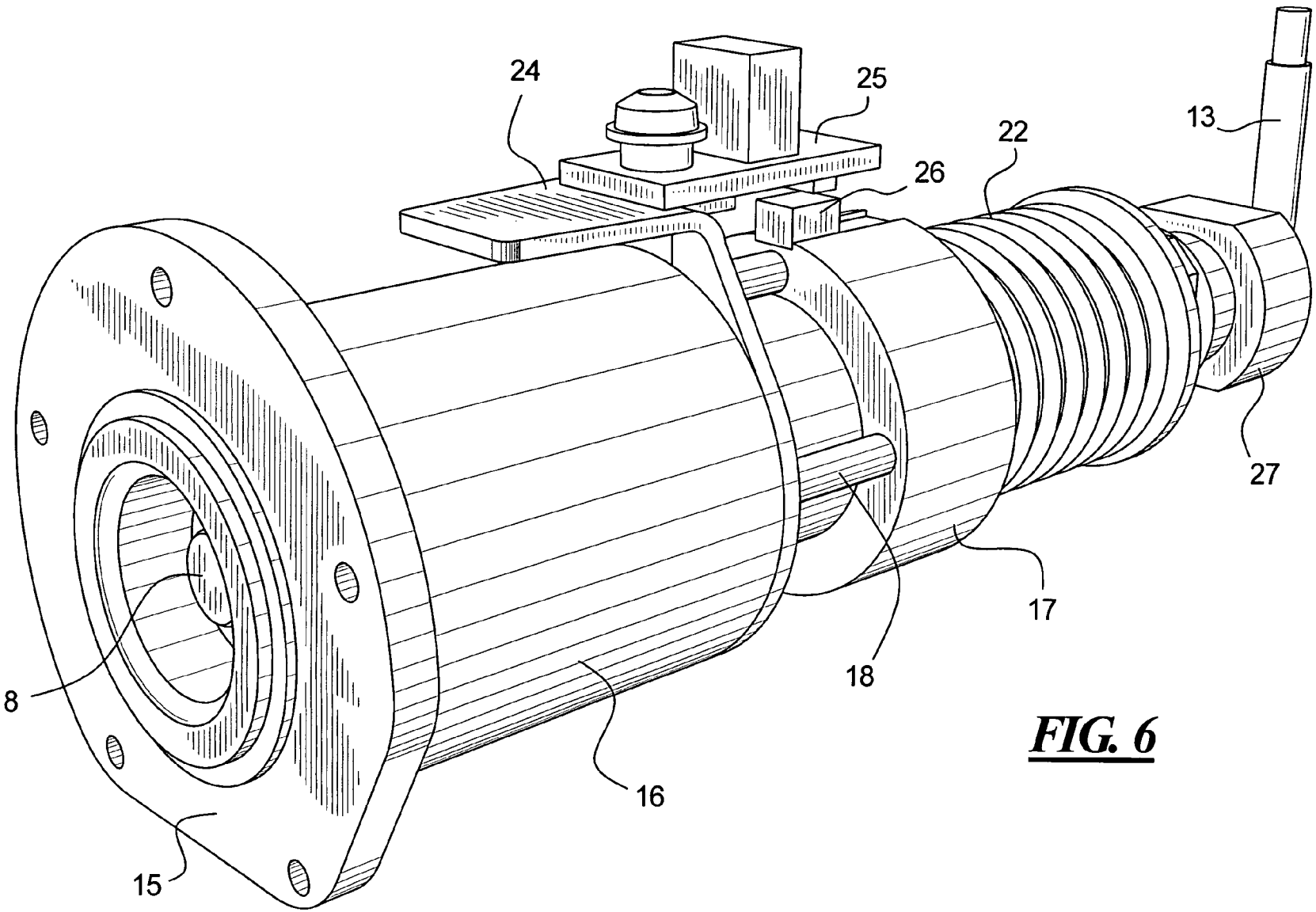
FIG. 6 is a 3D representation of the device.
Figure 7:
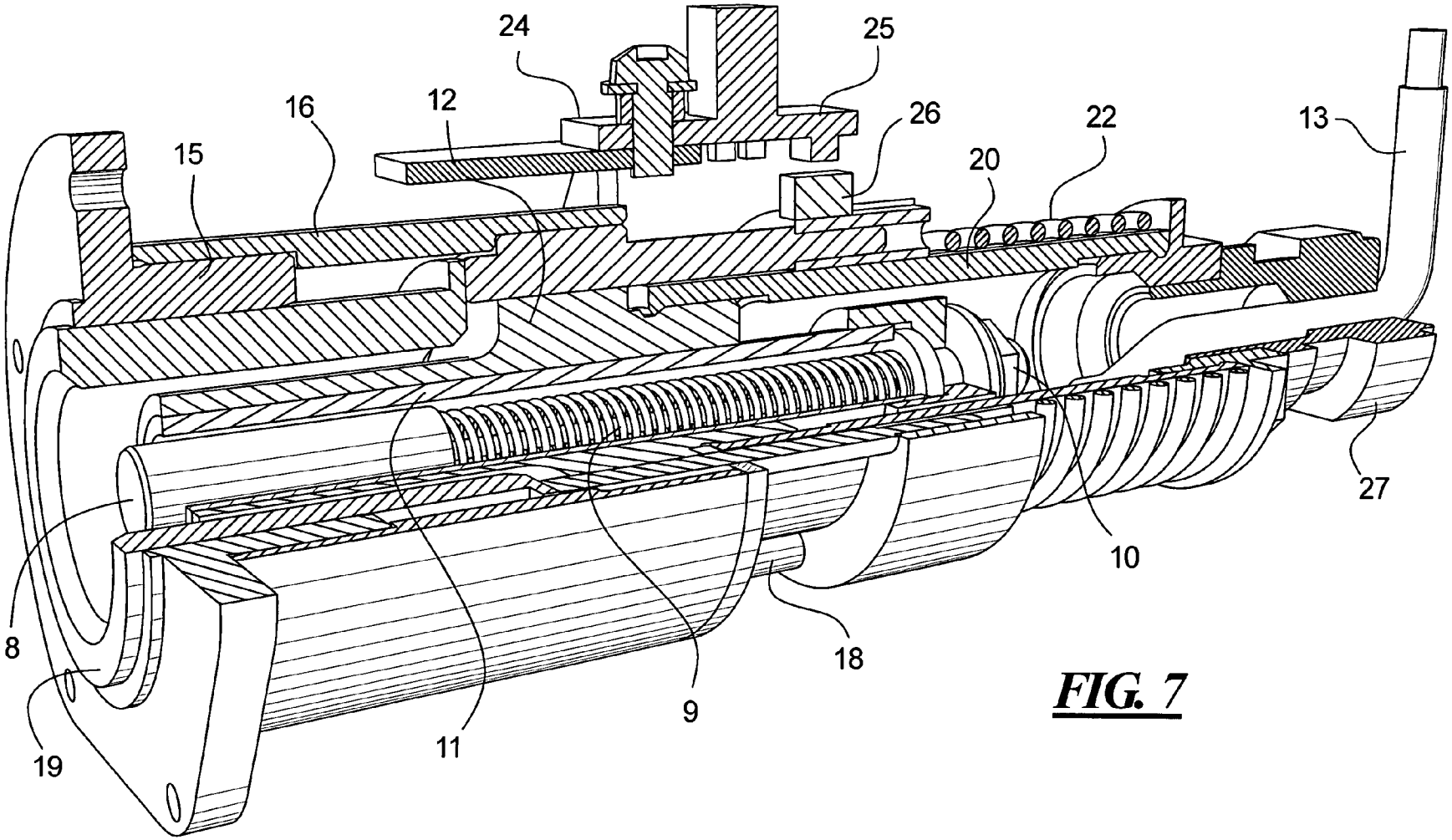
FIG. 7 is a section through the device in a 3D representation.

FIGS. 6 and 7 again show the device 4 as 3D representations, whereby FIG. 7 is a 3D section representation. The reference characters whose meaning results from the specification regarding FIGS. 4 and 5 have been inserted into FIG. 6 and FIG. 7.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim as our invention:

1. A system to transfer an electrical voltage to or from a rotating roller, one side of the roller being connected with a bearing for the roller, comprising:

a voltage transfer device that, on one side, elastically attaches to a voltage connection of the roller after connection of the voltage transfer device with the roller and which on the other side is connected with an external cable;

a compensation device designed such that it compensates axial play of the roller after connection of the roller with the voltage transfer device;

an electrically-conductive brush axially moveable in a fixed guide element and whose one side is aligned towards a front side of the voltage transfer device;

a sealing cap closing the guide element, the sealing cap being connected to the external cable, and an internal flexible cable going to the brush from the external cable; and a brush spring arranged between the brush and the sealing cap and which exerts an elastic effect on the brush.

2. A system according to claim 1 in which the guide element is mounted in a brush mounting that is arranged fixed in a forward tube.

3. A system according to claim 2 in which, at a front side, a forward flange is arranged fixed in the forward tube that is connected with the bearing of the roller.

4. A system according to claim 3 in which a bushing is borne in the forward flange such that it moves axially, and the compensation device exerting an elastic force on the bushing.

5. A system to transfer an electrical voltage to or from a rotating roller, one side of the roller being connected with a bearing for the roller, comprising:

a voltage transfer device that, on one side, elastically attaches to a voltage connection of the roller after connection of the voltage transfer device with the roller and which on the other side is connected with an external cable;

a compensation device designed such that it compensates axial play of the roller after connection of the roller with the voltage transfer device;

a rear tube in which a rear flange is inserted on a backside;

a bolt mounting axially moveable on the rear tube;

a compression spring that exerts an elastic force on the bolt mounting arranged on the rear tube between the bolt mounting and the rear flange; and bolts mounted in the bolt mounting that are in effective connection with a bushing.

6. A system according to claim 5 in which the bolts are guided into the brush mounting.

7. A system according to claim 5 in which the bushing is provided with a web to which the bolts connect, and that is formed such that the bushing cannot slide out of the device.

8. A system according to claim 5 in which the rear tube is closed with a cable threading through which the external cable is guided to a sealing cap.

9. A system according to claim 5 in which a monitoring device is provided that establishes whether the roller is connected with the voltage transfer device and wherein the monitoring device comprises a Hall switch comprising a magnet arranged on the bolt mounting and a sensor arranged on a sensor mounting fastened on a forward tube.

10. A system according to claim 5 in which the voltage transfer device comprises a brush axially moveable in a guide element and the guide element comprises an insulator.

11. A system according to claim 10 in which the guide element is mounted in a brush mounting and the brush mounting comprises an insulator.

12. A system according to claim 5 in which the roller comprises a transfer roller in a transfer printing station of an electrophotographic printing or copying device.

13. A method to produce a detachable electrical connection between a transfer roller in a transfer printing station of an electrophotographic printing or copying device and a voltage source, comprising the steps of:

providing a voltage transfer device having an elastic connection element that flexibly pushes against a surface serving as a voltage connection to the roller, said voltage transfer device being connected with said voltage source by an external cable;

compensating an axial play of the roller without effecting said voltage connection after connection of a voltage transfer device;

the voltage transfer device having a forward flange screwed to a bearing acceptance of the transfer roller for connection of the voltage transfer device to the transfer roller; and pressing a brush onto the voltage connection of the transfer roller, and pressing a bushing onto a bearing of the transfer roller.

14. A method of claim 13 including the step of positioning the elastic connection element pushing against the voltage connection surface during connection of the voltage transfer device with the roller.

15. A method according to claim 13 including the step of compensating said axial play of the roller after connection with the voltage transfer device without effecting a voltage transfer to the voltage connection of the roller.

* * * * *